United States Patent [19]

Anderson et al.

[11] 4,215,613

[45] Aug. 5, 1980

[54] SLITTING APPARATUS

[75] Inventors: Eric A. Anderson, Port Townsend, Wash.; Walter A. Maier, Syracuse, N.Y.

[73] Assignee: Eric A. Anderson, Part Townsend, Wash.

[21] Appl. No.: 901,601

[22] Filed: May 1, 1978

[51] Int. Cl.[2] ..... B26D 3/08

[52] U.S. Cl. ..... 83/864; 83/676; 83/854; 83/887

[58] Field of Search ..... 83/676, 835, 308, 332, 83/864, 863, 872, 873, 886, 887, 846–855; 30/347, 355

[56] References Cited

U.S. PATENT DOCUMENTS

| | | | |
|---|---|---|---|
| 167,308 | 8/1875 | Daniels | 83/676 |
| 1,691,102 | 11/1928 | Witham, Sr. | 144/193 R |
| 1,934,621 | 11/1933 | Criner | 83/873 |
| 2,465,058 | 3/1949 | Burkett | 83/676 |
| 2,839,099 | 6/1958 | Muller | 83/308 X |
| 3,293,962 | 12/1966 | Gianaris | 83/676 X |
| 3,346,956 | 10/1967 | Wezel et al. | 30/347 |
| 3,583,449 | 6/1971 | Thrasher | 83/835 |
| 3,762,249 | 10/1973 | Wheeler | 83/864 |
| 3,863,538 | 2/1975 | Behnke | 83/676 |

FOREIGN PATENT DOCUMENTS

| | | | |
|---|---|---|---|
| 439455 | 1/1927 | Fed. Rep. of Germany | 83/835 |
| 1479493 | 3/1967 | France | 83/676 |

*Primary Examiner*—J. M. Meister

*Attorney, Agent, or Firm*—Bruns & Jenney

[57] ABSTRACT

A kerfless slitter, capable of cutting various materials without generating chips or sawdust. The slitter includes a circular blade having a plurality of teeth spaced about its outer periphery and which contains a knife-edge centered along the mid plane of the blade in regard to its thickness. In practice, the blade is rotated at a peripheral speed that is equal to the linear speed of the work acted upon whereby each tooth is advanced along a cycloidal path of travel in reference to the work. Each tooth is arranged to enter the work ahead of the cutting line established by the teeth that have previously penetrated the work so that the cut is increased in length and in depth by means of a series of short slits.

10 Claims, 6 Drawing Figures

SLITTING APPARATUS

BACKGROUND OF THE INVENTION

This invention relates to a kerfless slitter and, in particular, to a kerfless slitter for producing straight edge pieces without the loss of material.

Although the apparatus is capable of slitting a wide variety of materials it is ideally suited for use in the lumber and woodworking industries in cutting a cant or board to a desired size. Traditionally, saws have been employed to carry out this task wherein the blade enters the work at a relatively high speed and cuts a kerf of some finite width in the workpiece. During the cutting operation, a good deal of material is removed by the blade as sawdust. It is well known that sawdust has little or no reclaimable value because the destruction of the wood fibers produced by the blade action renders the material unusable in the manufacture of paper or fiberboard products. As a consequence, most of the sawdust generated in the industry represents an unwanted waste product that is difficult to recycle and which is not readily disposable.

Attempts have been made to slit certain materials such as wood in order to reduce the amount of sawdust generated by conventional saws. As evidenced by U.S. Pat. Nos. 1,691,102; 1,788,456; 3,044,510 and 3,494,396 most of the efforts have been directed toward devices utilizing circular or linear knives having continuous uninterrupted blades. Typically the edge of the blade is forced into a moving workpiece while at the same time the blade is rotated or reciprocated at relatively high speeds to provide a cutting action. High speed movement of the blade oftentimes generates a good deal of heat which shortens the blade life and causes the work to become scored or burned. Similarly, driving the blade at these speeds also required the use of now critical energy.

As noted in the above cited patents, many slitters, in order to produce a relatively linear cut, require that the work be rigidly supported as it moves through the blade to prevent the work from walking while being acted upon by the high speed tool. Any interruption or inconsistency found in the work material, such as splits or grain deviations contained in wood, will tend to align themselves with the blade as it is being forced through the work causing the work to deviate from its intended path of travel thereby reducing the quality of the product. Even with the work well supported in the work zone, it is still possible to deform the thin blade as it is forced through the work which, again, reduces the quality of the final product.

SUMMARY OF THE INVENTION

It is therefore an object of the present invention to improve means for cutting slittable materials.

Another object of the present invention is to eliminate the amount of unusable waste material produced when a piece of material, such as wood, is cut.

A further object of the present invention is to provide a slitting apparatus that is capable of producing straight edge pieces without appreciable loss of material.

Yet another object of the present invention is to provide a slitting apparatus that is generally insensitive to interruption or changes in the consistency of the material acted upon.

A still further object of the present invention is to reduce the amount of energy required to slit various materials.

These and other objects of the invention are attained by means of a slitting blade that is circular in form and has a plurality of teeth spaced about its periphery, the blade further includes a generally continuous knife edge formed about its periphery that is normal to the blade's axis of rotation and which lies in the mid-plane of its width. Each tooth is contoured so that it initially enters the work ahead of the cutting line established by the teeth which have previously penetrated into the work whereby the length and the depth of the established cut is increased in relatively small increments.

BRIEF DESCRIPTION OF THE DRAWINGS

For a better understanding of these and other objects of the present invention reference is had to the following detailed description of the invention to be read in conjunction with the accompanying drawings, wherein.

DESCRIPTION OF THE INVENTION

Figure 6:
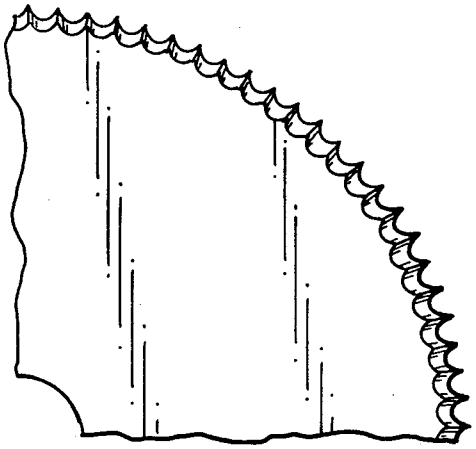
FIGS. 5 and 6 are fragmented side views of two further blade profiles which embody the teachings of the present invention.
Figure 5:
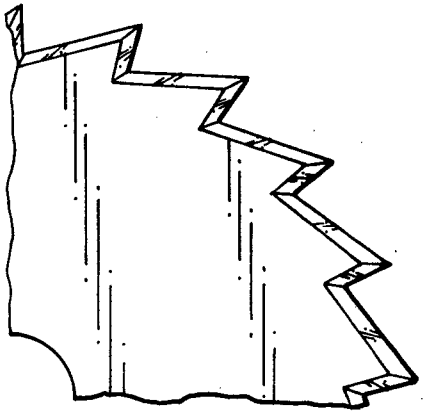

As noted, the present invention is well suited to cut a wide variety of slittable materials including various types of wood, many varieties of plastic, paper products, fiberboards and plywoods. The exact configuration of the blade profile is also not limited and the teeth contained therein may be formed of a series of planar surfaces as illustrated in FIG. 5, a plurality of cojoined curves or cusps as illustrated in FIG. 6 or a combination thereof.

Figure 1:
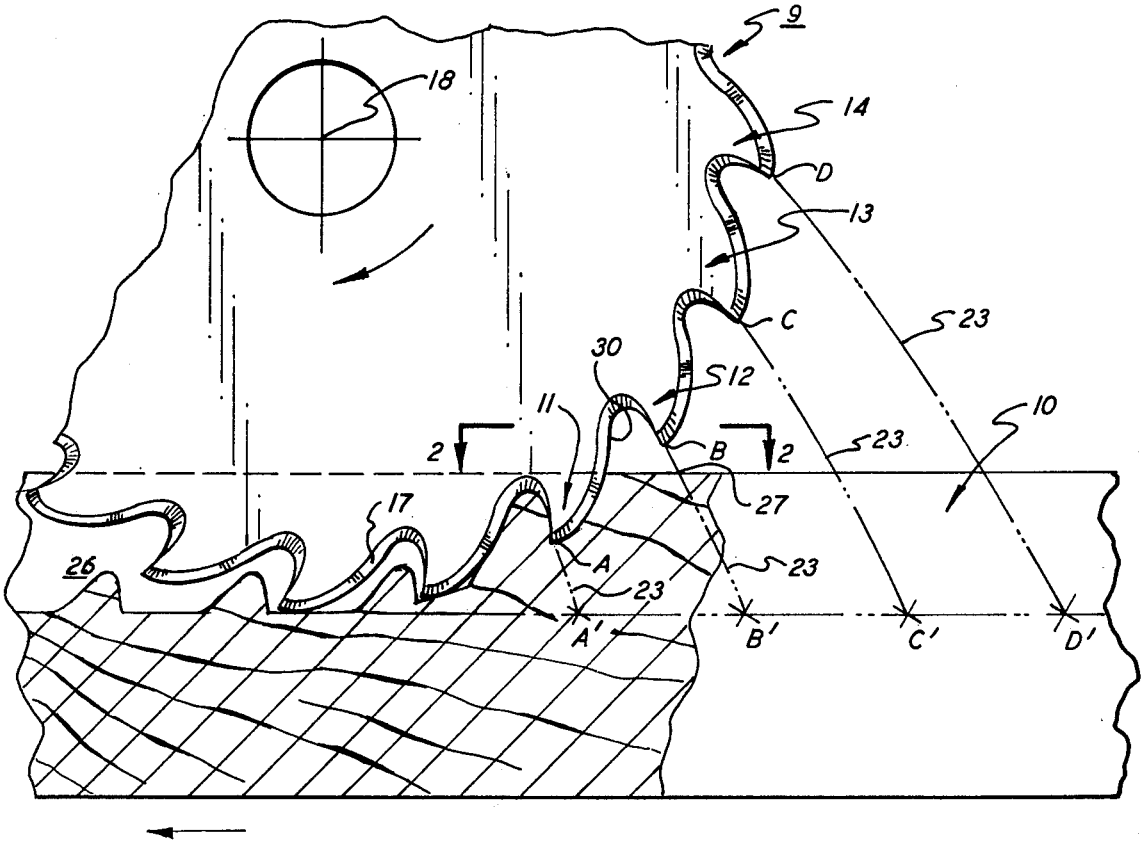
FIG. 1 is a side elevation illustrating a slitting tool embodying the present invention acting upon a work element having portions broken away to more clearly show the action of the tool.
Figure 3:
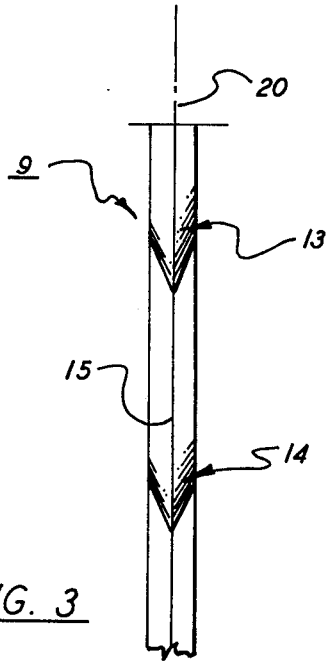
FIG. 3 is an enlarged partial end view of the tool illustrated in FIG. 1 further showing the knife-edge configuration of the teeth contained therein.

Referring now to FIG. 1, a circular slitter blade 9, embodying the teachings of the present invention, is shown acting upon a wooden work element 10. The blade contains a number of equally spaced teeth situated about its periphery, some of which are referenced by the numerals 11–14. Unlike a typical saw blade, the outer periphery of the present blade is honed to a keen knife edge 15 (FIG. 3) with the edge being substantially continuous about the blade and lying in the mid plane 20 of the blade width generally normal to the axis of blade rotation 18. The knife edge is formed by bevelling or grinding the outer end faces 17 of the blade to a fine edge that can easily slit or otherwise penetrate the work material and thereby produce a clean, well defined cut.

Regardless of the tooth profile involved, each tooth situated on the blade of the instant invention is arranged to initially make contact with the work at a point that is some distance ahead of the cutting line established in the workpiece by the combined action of the teeth that have already penetrated the work. In reference to the blade shown in FIG. 1, these points of initial contact are clearly defined at points A–D on teeth 11–14. However, on a blade containing outwardly curved, or scalloped shaped teeth, the initial contact point will be less pronounced but it should be understood that this type of blade will cut in the same manner as will be described in greater detail below.

Although not shown in FIG. 1, the workpiece 10 is supported upon a flat working surface or table and the blade 9 is rotated about its axis by any suitable drive means. As will be pointed out below, other blade and work driving arrangements may be herein employed without departing from the teachings of the invention provided that the linear speed of the work is maintained substantially equal to the peripheral speed of the blade. In operation, as each tooth on blade 9 contacts and enters the work, a straight edge slit is created in the work material and, under the influence of the moving blade, the work is pushed through the blade in the direction indicated by the arrow.

Figure 2:
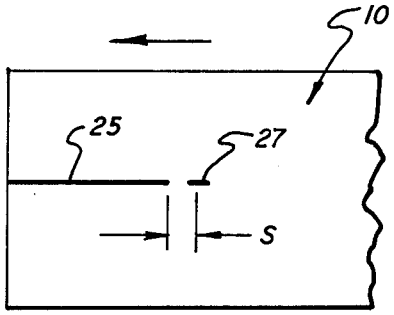
FIG. 2 is a top view of the work element taken along lines 2—2 in FIG. 1 illustrating the cutting line established in the work element.

By substantially eliminating any speed difference between the blade and the work, the individual teeth on the blade are caused to approach and penetrate the work along a predictable path of travel which is described by a cycloid. For example, as tooth 12 on blade 9 approaches the work point B on the tooth moves towards point B' in the work along cycloidal path 23. The point B on the tooth initially contacts and enters the top surface of the work at entry situs 27 which is located ahead of the main cutting line 25 formed in the work by the combined action of the teeth that have previously penetrated the material. This condition is more graphically illustrated in FIG. 2. The other teeth on the blade follow similar or common cycloidal paths 23–23 as exemplified by points A–D on teeth 11–14 in FIG. 1.

As can be seen, the profile of each tooth on the blade is generated so that the tooth contains one point on its periphery that will initially contact and enter the work ahead of the previously established cut 26. This distance S between the point of entry and the end of the established cutting line (FIG. 2) is matched to the slitting characteristics of the work material to insure that a straight edged cut in the piece is produced. In practice, as point B on tooth 12 enters the work and moves in a downward direction, the cutting edge 30 on the trailing edge of the forward adjacent tooth 11 slits back into the widening entry area thereby increasing the length and the depth of the established slit in proportion to the distance S.

As a result of the above noted blade action, the workpiece is slit by a series of relatively small incremental cuts rather than forcing a fast moving blade through the work as in the case of many prior art slitters. By initiating each incremental cut or slit ahead of the main cutting line, the blade is only called upon to expand the slit in small additions. Consequently, when the work material is grainy, or contains a number of fissures or other types of interruptions therein, the teeth of the blade will continually and automatically slit within the plane of the established cut rather than attempting to change direction and follow material boundaries. Stated another way, by keeping each incremental slit small, the individual teeth on the blade will act in concert to continually hold the blade on the desired path of travel rather than being directed therefrom by desired path of travel rather than being directed therefrom by discontinuities in the texture of the work material. As a result of this action, a straight edged cut is produced without the need of generating large amounts of unwanted sawdust or work chips.

Figure 4:
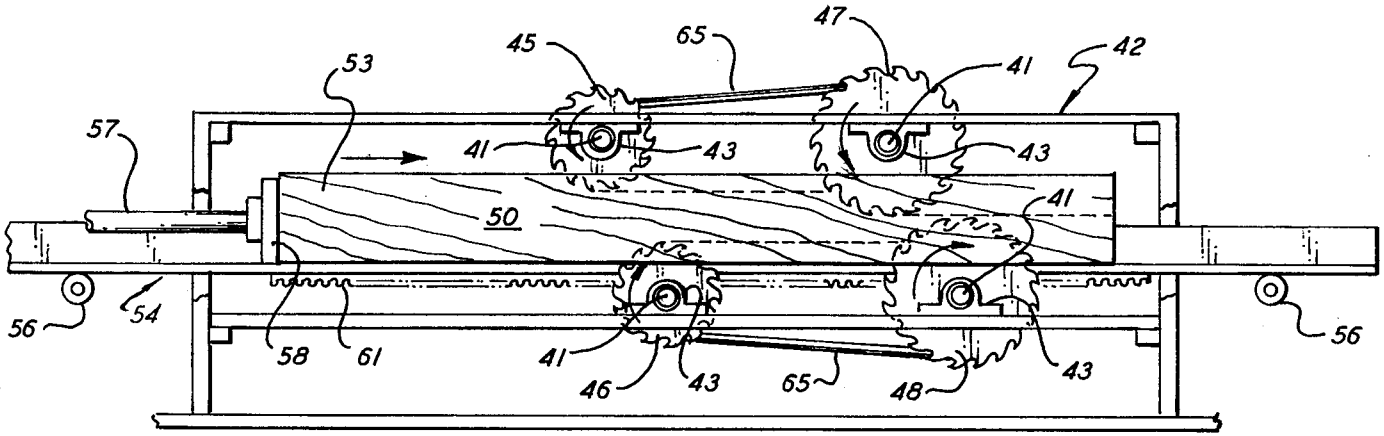
FIG. 4 is a side elevation of a machine for slitting wood or the like which utilizes a plurality of slitting tools embodying the teachings of the present invention.

Referring now to FIG. 4, there is shown apparatus for further implementing the teachings of the present invention. In this embodiment, four slitter blades as described above are rotatably mounted within a frame 42 upon shafts 41—41 supported in bearing blocks 43—43. This four blade array includes two smaller forwardly mounted blades 45, 46 and two larger rearwardly mounted blades 47, 48. In assembly, the upper pair of blades 45 and 47 act in tandem to produce a vertical straight line slit in the top of a workpiece 53 moving through the work zone 50 of the device. Similarly, the lower pair of blades 46, 48 act together to produce a straight line vertical slit in the bottom of the workpiece. The four blades are all mounted in the same plane and the depth of the upper and lower slits are brought past the mid-point of the work so that under the combined action of the blades, the workpiece is cut into two parts.

In this particular embodiment, the workpiece rather than the blades may provide the motive force for the system. As illustrated in FIG. 4, the workpiece 53 is mounted upon a movable table 54 with the back of the work in contact with a vertically aligned back plate 58 depending upwardly from the table. The table is moved from left to right through the work zone upon cooperating rollers 56–56, or any other suitable slide mechanism, by the action of a drive arm 57 acting against the vertical back plate 58. The arm is operatively affixed to a hydraulic or mechanical ram capable of delivering sufficient energy to move the work through the blades. As the teeth of the individual blades contact the work, the blades are caused to rotate upon the shafts in the direction indicated to slit the workpiece in the manner described above. As can be seen, in this application the blades are thus automatically turned at about the same speed as that of the work as it is being moved through the work zone. Accordingly, a straight planar cut is produced in the work. Because of the self tracking feature of the present blade, the work does not have to be guided through the work zone or side pressure applied thereto.

When relatively thick pieces of material are being treated by the slitter, it may be desirable to positively drive both the work and the blades to further insure that effective slitting is achieved. It should be clear that the blades in this application are positively driven to insure that they continually move at the same speed as the work, and thus deliver an optimum slitting action. Any simple type of system can be employed to accomplish this end. As seen in FIG. 4, the motion of the work can be coordinated with the blades by affixing a rack 61 to the bottom of the movable table which meshes with a pinion (not shown) affixed to the shaft of lower blade 46. Proper sizing of the pinion causes the blade to rotate at the desired speed. Through means of a series of pulleys, the other blades may also be driven at the prescribed speeds via belts 65 in a manner that is well known in the art.

While this invention has been described with reference to the structure herein disclosed, it is not necessarily confined to the details as set forth in this application is intended to cover any modifications or changes as may come within the scope of the following claims.

We claim:

1. Apparatus for slitting a workpiece including a circular blade having a plurality of radially extended teeth formed about its outer periphery and having a continuous knife-edge formed about its entire outer periphery which lies in the midplane of the blade, each tooth on the blade having a point that lies upon a radial line of the blade with the leading edge of the two side edges forming the point being situated on or behind the radial line in regard to the intended direction of blade rotation, and the point of each tooth being arranged to enter the work generally perpendicular thereto when the work and the blade are moving at the same speed whereby the trailing side edge of the tooth will completely penetrate the work only after the point of the following tooth has entered the work whereupon the work is slit in relatively short controlled increments.

2. The apparatus of claim 1 wherein the teeth are equally spaced about the periphery of the blade.

3. The apparatus of claim 1 whereby the trailing edge of each blade is arcuate in form.

4. Apparatus for slitting a workpiece that includes at least one circular slitter blade having a plurality of teeth formed about its periphery and further having a continuous knife-edge formed about the entire periphery that lies in the midplane of the blade, drive means for moving the blade and a workpiece through a work zone at equal speeds whereby each tooth on the blade moves toward the work along a cycloidal path of travel, each tooth on the blade having a point that lies upon a radial line of the blade with the two side edges of the tooth which form the point being situated behind the radial line in regard to the direction of blade movement whereby the point of each tooth penetrates the work generally perpendicular to the work and the trailing edge of each tooth completely enters the work only after the point of the following tooth has penetrated the work.

5. The apparatus of claim 4 wherein said drive means is arranged to positively move the workpiece through the work zone.

6. The apparatus of claim 4 wherein the drive means is arranged to positively move the blade through the work zone.

7. The apparatus of claim 4 wherein a plurality of blades are adapted to act upon a single workpiece.

8. The apparatus of claim 7 that further includes a first set of blades that are mounted in tandem within a plane so as to enter the top of the workpiece and a second set of blades also mounted in tandem within said plane so as to enter the bottom of the workpiece.

9. The apparatus of claim 8 wherein each blade in a set is of a different diameter.

10. The apparatus of claim 9 wherein the slit created by the first set of blades meets the slit created by the second set of blades thereby severing the workpiece in two.

* * * * *